US007481513B2

(12) United States Patent
Hsieh

(10) Patent No.: US 7,481,513 B2
(45) Date of Patent: Jan. 27, 2009

(54) MAINTENANCE DEVICE FOR INKJET CARTRIDGE

(75) Inventor: Yen-Sung Hsieh, Taipei (TW)

(73) Assignee: Qisda Corporation, Taoyuan County (TW)

( * ) Notice: Subject to any disclaimer, the term of this patent is extended or adjusted under 35 U.S.C. 154(b) by 459 days.

(21) Appl. No.: 11/380,206

(22) Filed: Apr. 25, 2006

(65) Prior Publication Data

US 2006/0244780 A1 Nov. 2, 2006

(30) Foreign Application Priority Data

Apr. 27, 2005 (TW) ..... 94113459 A

(51) Int. Cl.
*B41J 2/165* (2006.01)

(52) U.S. Cl. ..... 347/33

(58) Field of Classification Search ..... 347/33
See application file for complete search history.

(56) References Cited

U.S. PATENT DOCUMENTS

2003/0035019 A1* 2/2003 Dietl et al. ..... 347/33
2004/0246296 A1* 12/2004 Nakashima ..... 347/32

* cited by examiner

*Primary Examiner*—Julian D Huffman
*Assistant Examiner*—Jason S Uhlenhake

(57) ABSTRACT

A maintenance device for an inkjet cartridge that cleans a print head of the cartridge. The maintenance device has a sled and a cam, which allow an end of a wiper holder to move up and down. As a cartridge pushes the sled, a sliding pin extended from the wiper holder moves in an L-shaped slit of the sled, allowing the end of the wiper holder to move upward. After the cleaning of the print head, the cartridge pushes the cam downward to move the end of the wiper holder downward.

10 Claims, 11 Drawing Sheets

MAINTENANCE DEVICE FOR INKJET CARTRIDGE

BACKGROUND OF THE INVENTION

1. Field of the Invention

The present invention relates to a maintenance device for an inkjet cartridge, and more specifically, to a maintenance device with one end of a wiper holder capable of moving up and down.

2. Description of the Prior Art

Copy machines, fax machines, and printers are commonly used for processing documents at work places. To meet the requirement of high printing quality, most inkjet printers have maintenance devices for print head cleaning and maintenance to avoid ink problems and ensure future printing precision. A wiper is installed on the maintenance device for scrubbing residual ink on the print head using relative movement between the wiper and the print head.

FIG. 1 illustrates different states of a wiper of a prior art maintenance device 1 for an inkjet cartridge. The maintenance device 1 comprises a wiper sliding platform 10 and a wiper base 12. The wiper sliding platform 10 has a wiper 6A and a wiper 6B for scrubbing ink from the print heads. The wiper sliding platform 10 moves right with its sliding pins 8A and 8B sliding along the slits 14A and 14B inside the wiper base 12.

In state Sa of FIG. 1 a carrier 2 drives the cartridges 4A and 4B to the maintenance device 1. As the carrier 2 moves right, it contacts and pushes the wiper sliding platform 10 to move right, too. As state Sb of FIG. 1 shows, the carrier 2 pushes the wiper sliding platform 10 right, along with the sliding pins 8A and 8B installed on the wiper sliding platform 10. The sliding pins 8A and 8B slide in the slits 14A and 14B respectively of the wiper base 12. As the sliding pins 8A and 8B slide right a distance S, the upward slopes of the slits 14A and 14B lift the slits 8A and 8B and the wiper sliding platform 10 a fixed height. The wipers 6A and 6B installed on the wiper sliding platform 10 will then rise to a predetermined position so that the wipers 6A and 6B can contact the surfaces F of the cartridges 4A and 4B. The maintenance device 1 will keep the wipers 6A and 6B at the predetermined position while the carrier 2 drives the cartridges 4A and 4B backward, causing a moving contact between the wipers 6A, 6B and the surfaces F of the cartridges 4A, 4B to scrub ink from the print heads, thus cleaning the print heads.

The slopes of the slits 14A and 14B of the prior art maintenance device 1 make the wiper sliding platform 10 lift from a height in state Sa to a height in state Sb. Such slopes in the maintenance device 1 require an extra width for sliding to drive the wiper sliding platform 10 to a predetermined height. Therefore, an extra cost for an enlarged size of the maintenance device 1 exists, and possibilities for further miniaturization are reduced.

SUMMARY OF THE INVENTION

Therefore, the primary objective of the claimed invention is to provide a maintenance device for an inkjet cartridge to solve the above problem.

The claimed invention provides a maintenance device for an inkjet cartridge. The maintenance device comprises a housing; a wiper holder having a sliding pin; a sled installed in the housing capable of moving left and right, having a slit through which the sliding pin extends and slit allowing the sliding pin to move an end of the wiper holder up and down; an axle installed in the sled; and a cam connected to the axle having a slit through which the sliding pin extends. The cam, when pushed downward by the cartridge, presses down the sliding pin, moving the sliding pin down along both the slit of the sled and the slit of the cam, thus moving the end of the wiper holder downward.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
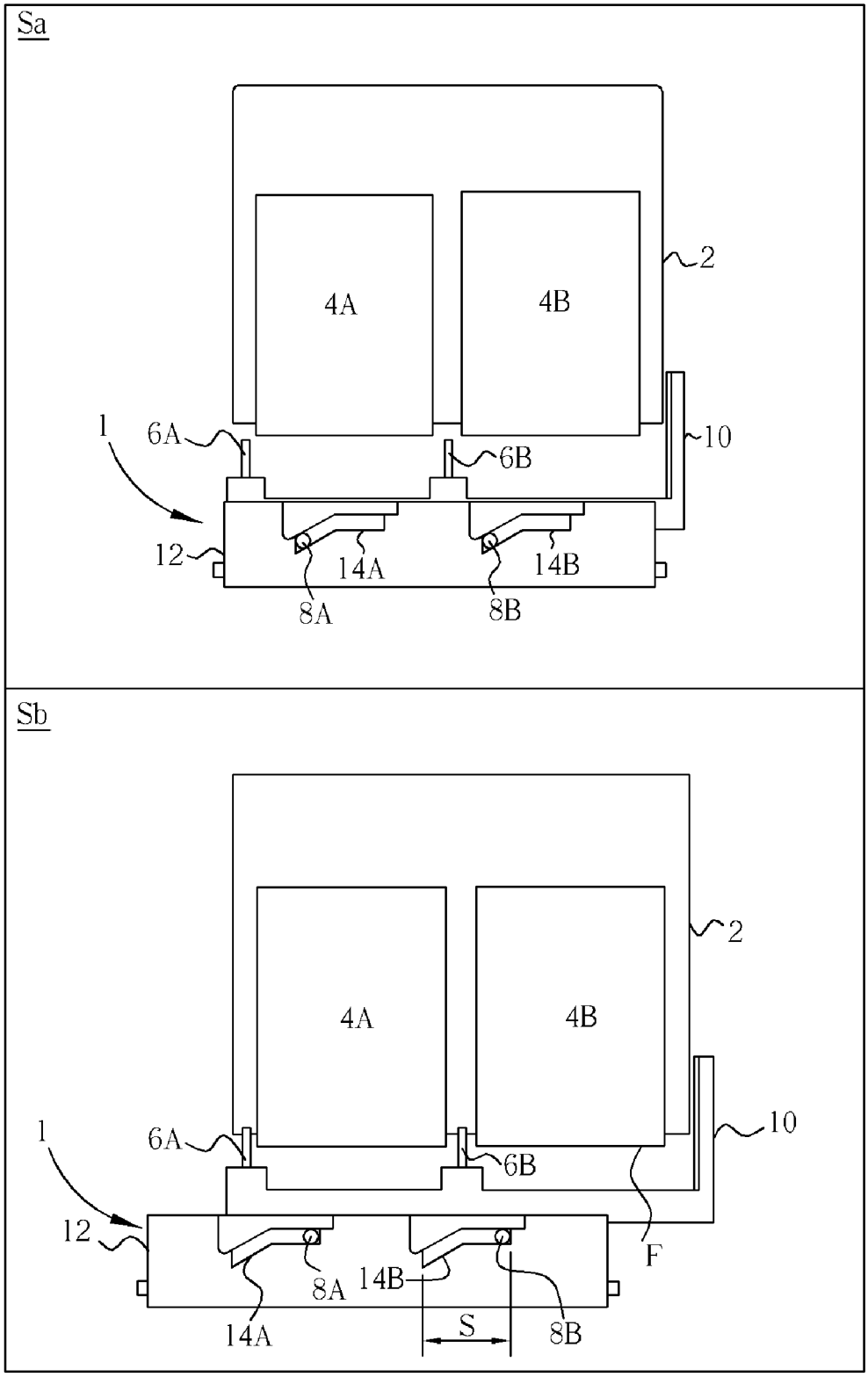
Fig. 1 Prior Art
FIG. 1 illustrates different states of a wiper of a prior art maintenance device for an inkjet cartridge.
Figure 2:
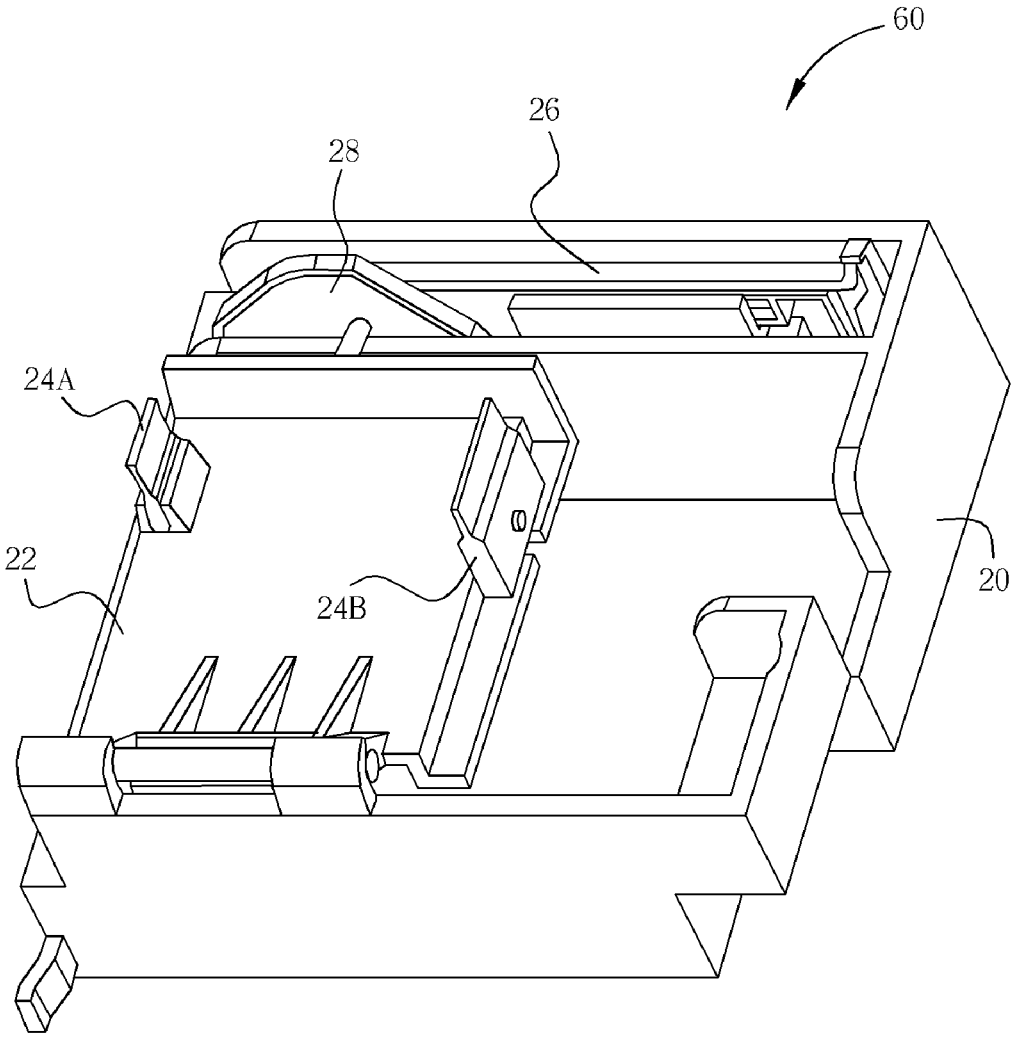
FIG. 2 is an illustration of the present invention maintenance device for an inkjet cartridge.

Please refer to FIG. 2, which is an illustration of a present invention maintenance device 60 for an inkjet cartridge. The maintenance device 60 comprises a housing 20, a wiper holder 22, a sled 26 installed in the housing 20 capable of moving left and right, and a cam 28. The wiper holder 22 comprises a plurality of wipers 24A and 24B for cleaning residual ink from the print heads of the cartridges.

Figure 3:
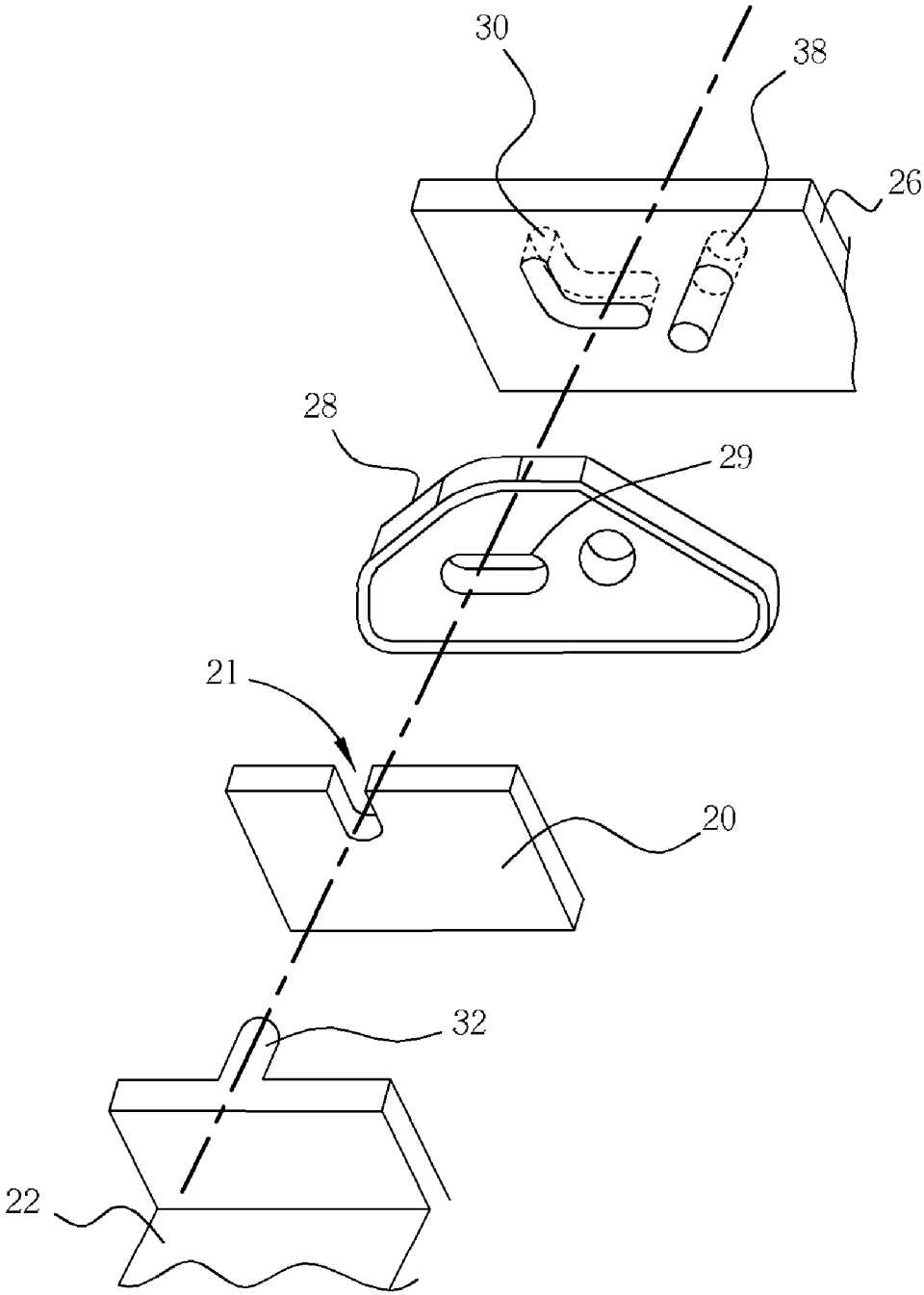
FIG. 3 is an illustration of parts of the maintenance device of FIG. 2.

Please refer to FIG. 3, which is an illustration of several parts of maintenance device 60 for an inkjet cartridge. As shown, the wiper holder 22 has a sliding pin 32, the sled 26 has an L-shaped slit 30, and the cam 28 has a straight slit 29. The cam 28 connects to the sled 26 through an axle 38 on the sled 26. The sliding pin 32 on the wiper holder 22 extends through a notch 21 of the housing 20 to the slit 29 of the cam 28 and to the slit 30 of the sled 26, and slides within the slit 29 and the slit 30, generating relative movement.

Figure 4:
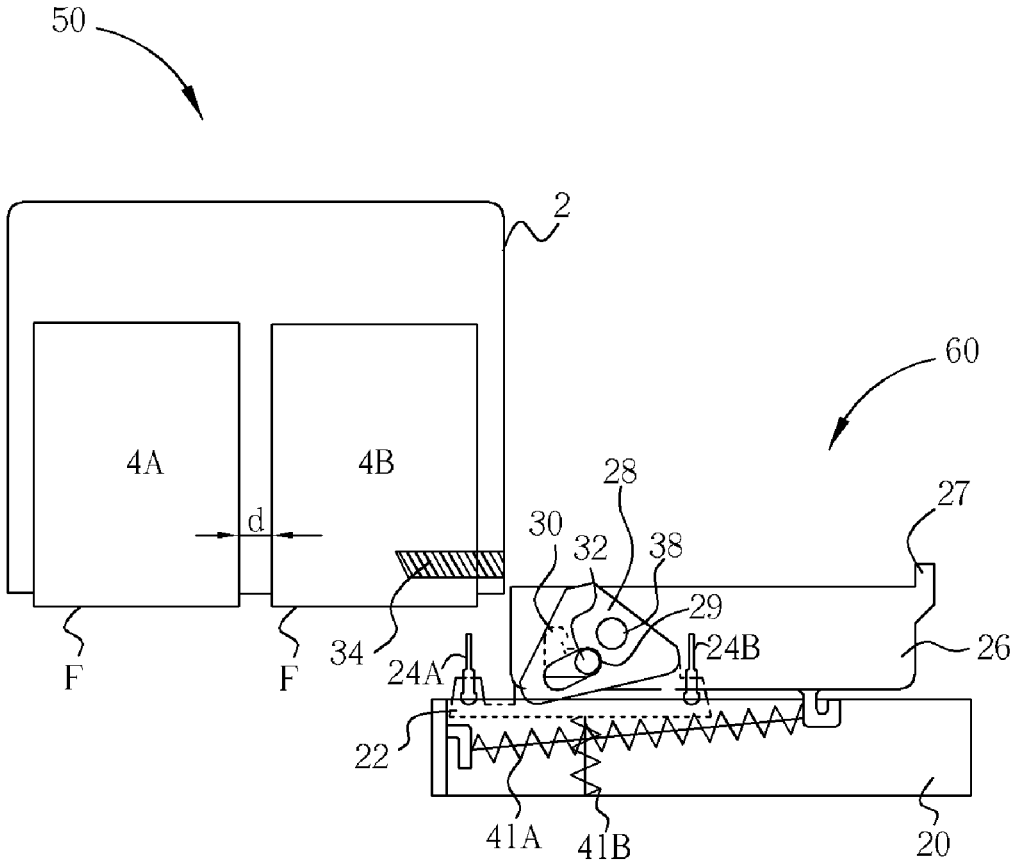
FIG. 4, FIG. 6, FIG. 8, and FIG. 10 are illustrations of a front view of the maintenance device of FIG. 2 at different stages.
Figure 5:
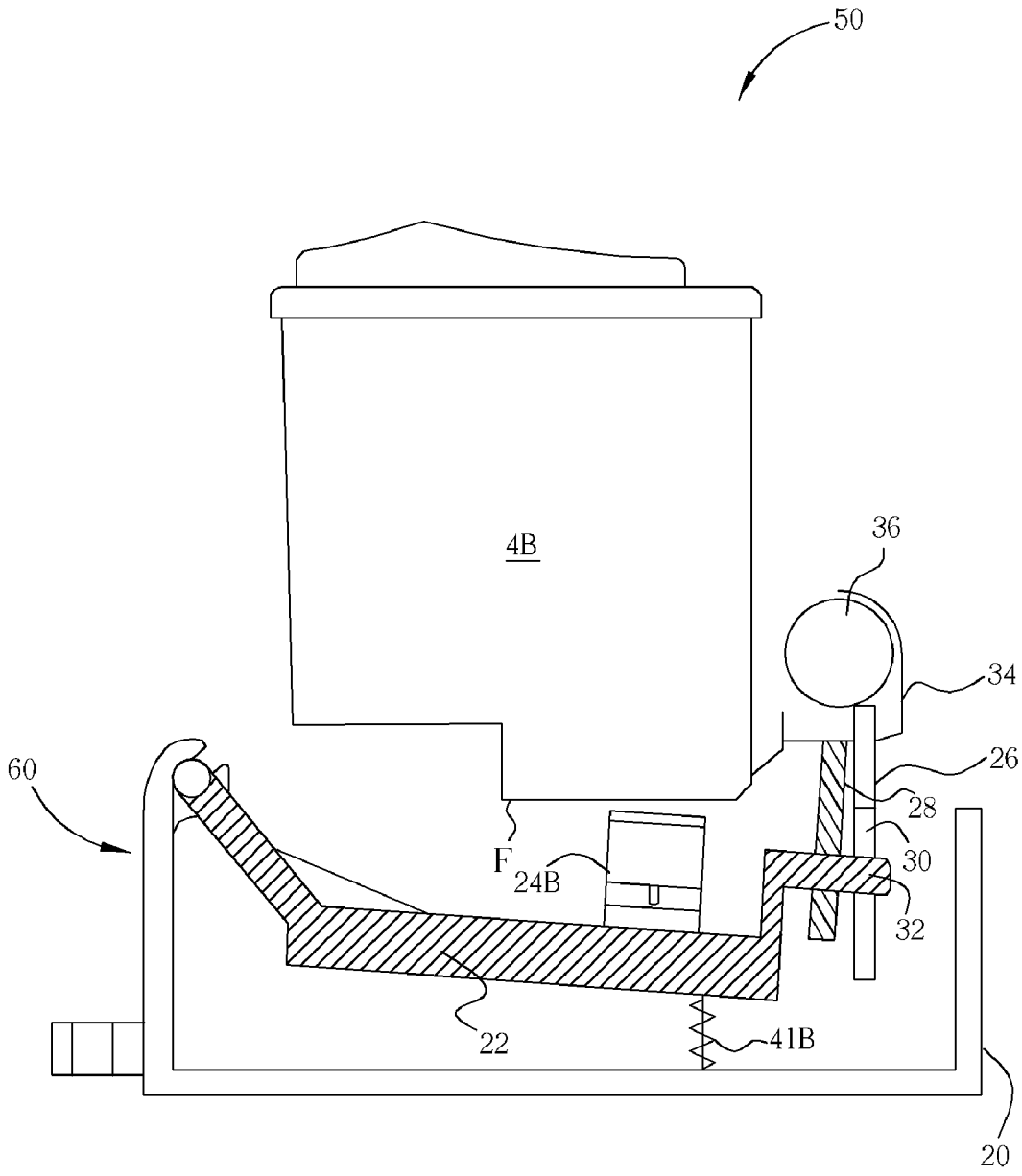
FIG. 5, FIG. 7, FIG. 9, and FIG. 11 are illustrations of a side view of the maintenance device of FIG. 2 at different stages.
Figure 6:
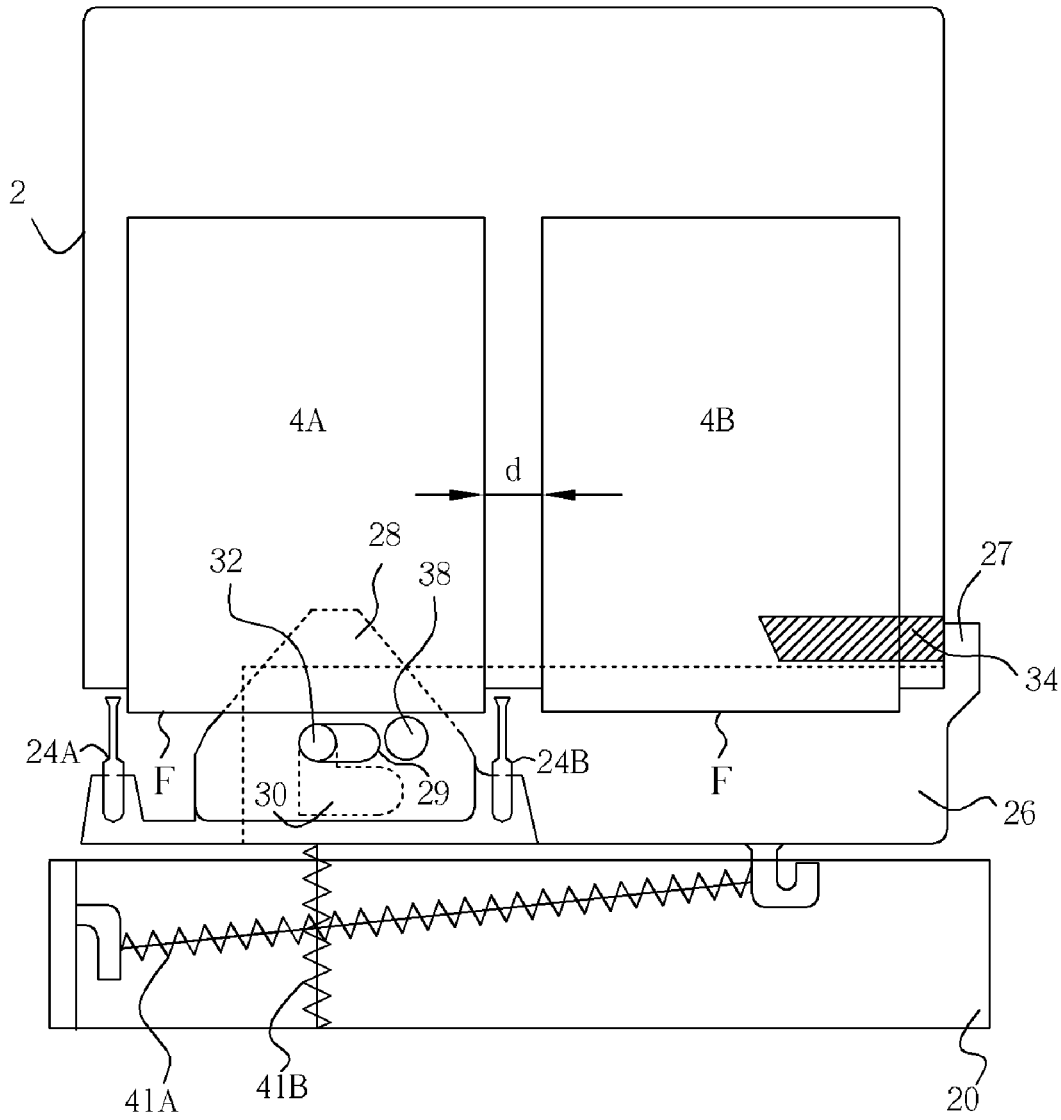
Figure 7:
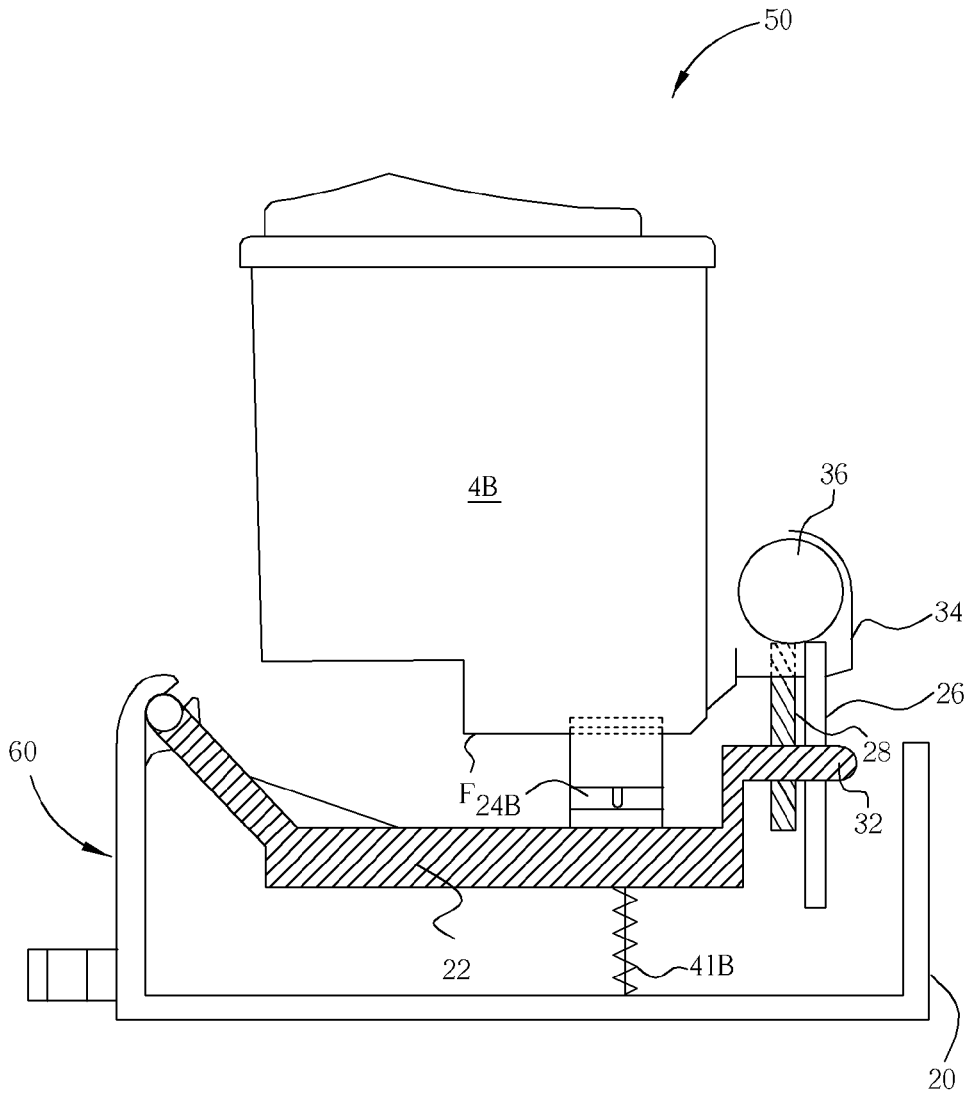
Figure 8:
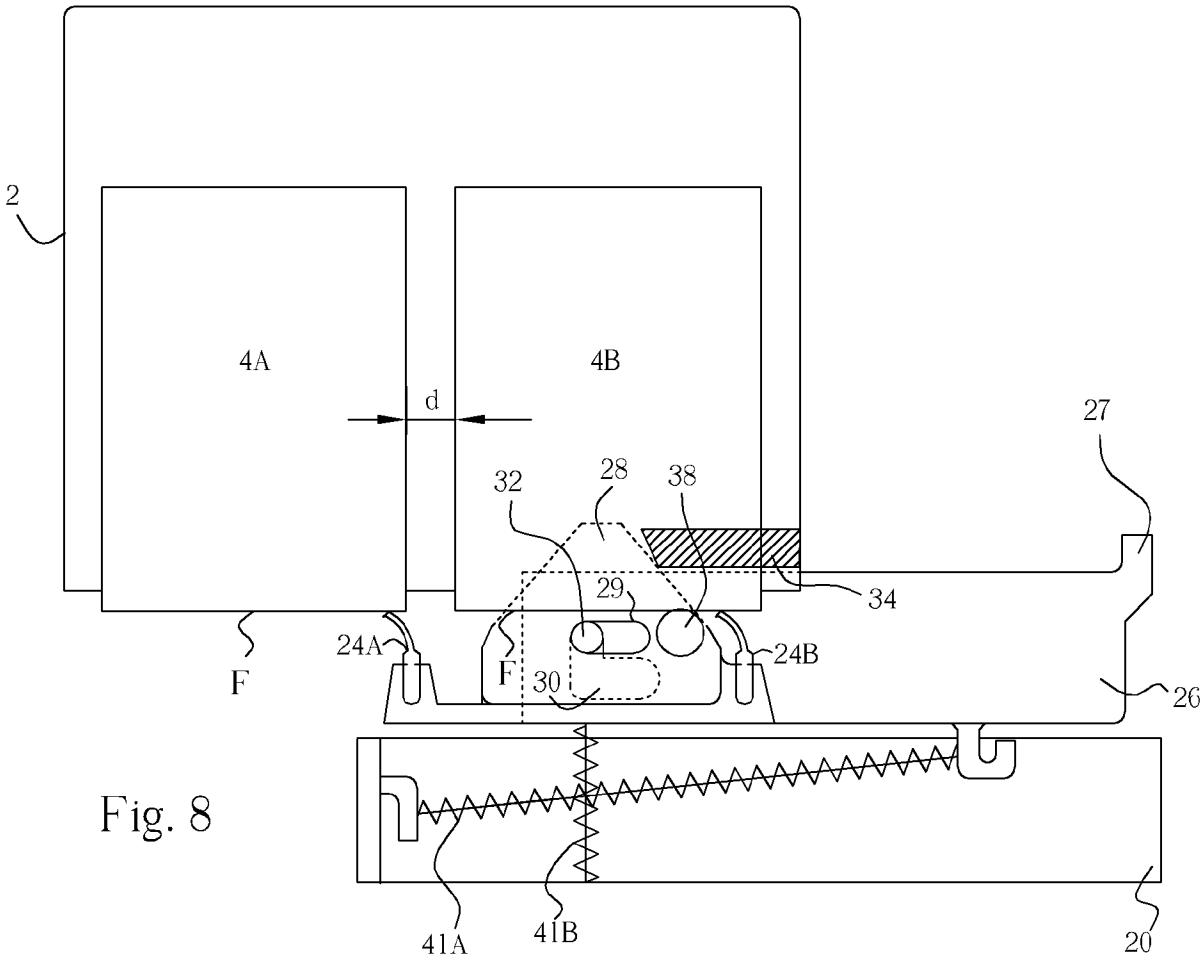
Figure 9:
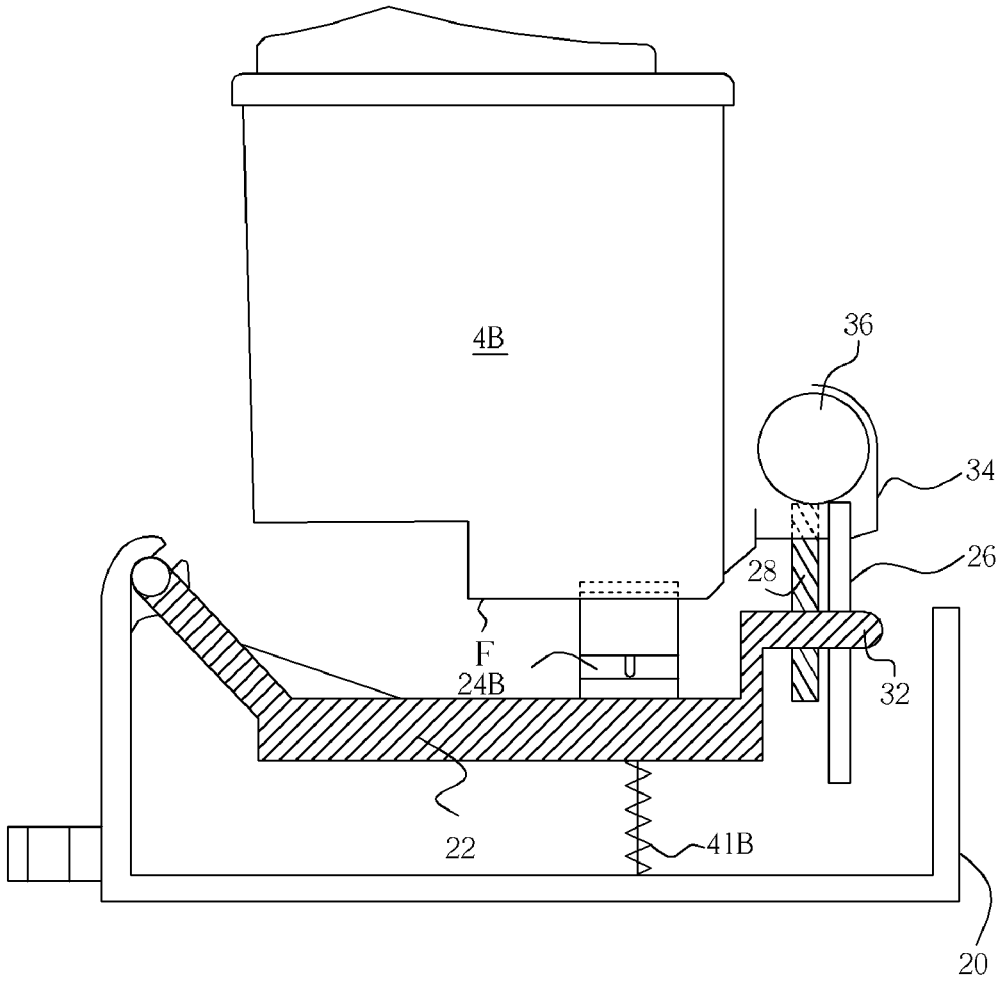
Figure 10:
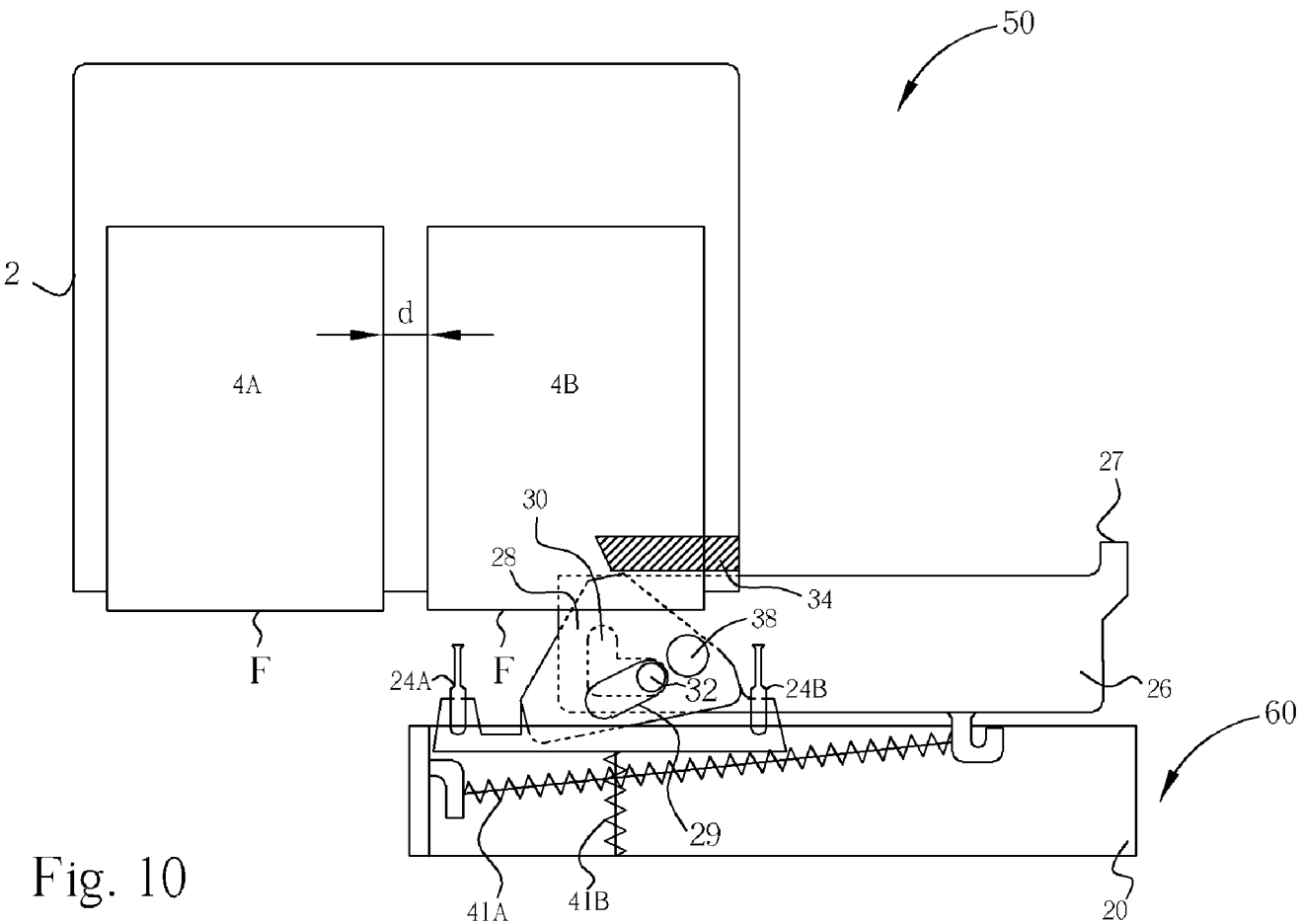
Figure 11:
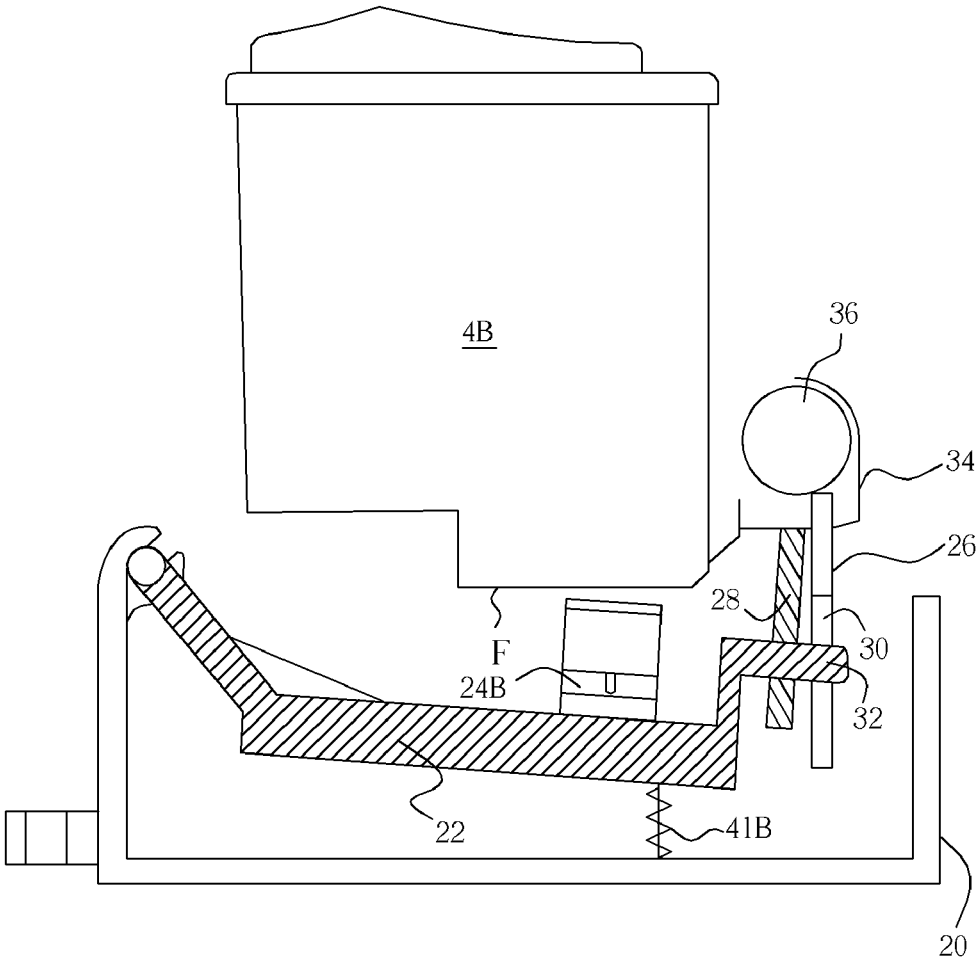

FIG. 4 to FIG. 11 are illustrations of each state of action between the present invention maintenance device 60 and the carrier 2. FIG. 4 shows a first state, illustrating a front view of the maintenance device 60 as the carrier 2 approaches. FIG. 5 is the side view of the illustration in FIG. 4. FIG. 6 shows a second state, illustrating a front view of the maintenance device 60 when the carrier 2 pushes the sled 26, lifting up the wipers 24A and 24B. FIG. 7 is the side view of the illustration in FIG. 4. FIG. 8 shows a third state, illustrating a front view of the maintenance device 60 when the carrier 2 moves backward causing the wipers 24A and 24B to rub against the surfaces F of the print heads, thereby scrubbing residual ink. FIG. 9 is the side view of the illustration in FIG. 8. Lastly, FIG. 10 shows a fourth state, illustrating a front view of the maintenance device 60 when a pressing rod 34 of the carrier 2 presses the cam 28 restoring the maintenance device 60 to the first state. FIG. 11 is the side view of the illustration in FIG. 10.

Please refer to FIG. 4 and FIG. 5. A power source (such as a motor) of the printer 50 provides the printer 50 with a horizontal driving force. When the printer 50 starts printing, the power source drives the cartridges 4A and 4B to move back and forth along the guiding shaft 36. In the first state, the cam 28 of the maintenance device 60 is at a lower position.

The wiper holder 22 is connected with the housing 20 through an elastic element 41B, which is compressed. The sliding pin 32 on the wiper holder 22 is at the right end of the L-shaped slit 30 of the sled 26. Since the location of the sliding pin 32 in the slit 30 prevents the sliding pin 32 from moving upward, the elastic element 41B can be kept compressed.

Relative to the wipers 24A and 24B, the surfaces F of the cartridges 4A and 4B are at a higher position, which means that the pressing rod 34 will not collide with the maintenance device 60 when the printer 50 is printing.

Please refer to FIG. 6 and FIG. 7. When the surfaces F of the cartridges 4A and 4B are to be cleaned, the power source moves the carrier 2 right with the cartridges 4A and 4B along the guiding shaft 36 until the pressing rod 34 of the carrier 2 touches and pushes a protrusion 27 of the sled 26, moving the sled 26 to slide right. Meanwhile, the slit 30 of the sled 26 moves right as well. The sliding pin 32 extended to the slit 30 can be regarded as moving left with respect to the slit 30. When the sled 26 moves right due to the push of the pressing rod 34 of the carrier 2 and the sliding pin 32 moves to the corner of the L-shaped slit 30, the limitation of vertical movement on the sliding pin 32 in the first state is released. The compressed elastic element 41B in the first state then pushes the sliding pin 32 and the wiper holder 22 upward. Thus, the wipers 24A and 24B on the wiper holder 22 rise to a higher position that can contact with the surfaces F of the print heads. At this time, the lifted wipers 24A and 24B are at the gaps d beside cartridges 4A and 4B.

On the other hand, the sliding pin 32 extending to the slit 29 of the cam 28 slides in the slit 29 and drives the cam 28 to rotate in a small range about the axle 38 and rise a small height. When the protrusion 27 of the sled 26 is driven right by the pressing rod 34 of the carrier 2, an elastic element 41A connected between the housing 20 and the sled 26 in the maintenance device 60 is also stretched, generating a restoring force. When the elastic element 41B springs upward, pushing the sliding pin 32 and one end of the wiper holder 22 to rise, the sliding pin 32 moves to the top of the slit 30 along the L-shaped slit 30. At this position, the sliding pin 32 restricts the sled 26 from moving horizontally; hence the elastic element 41A is kept in stretched state and cannot pull back the sled 26.

Please refer to FIG. 8 and FIG. 9, which illustrate the maintaining action of the maintenance device 60. The carrier 2 slides left along the guiding shaft 36 and the wipers 24A and 24B leaves the gaps d and move to the right relatively. The wipers 24A and 24B contact the surfaces F and are deformed. The cartridges 4A and 4B on the carrier 2 keep moving left and the wipers 24A and 24B scrub the surfaces F to clean the surfaces F until the pressing rod 34 of the carrier 2 pushes the right bevel of the cam 28, pressing down the cam 28 and advancing to the next state shown in FIG. 10 and FIG. 11.

Please refer to FIG. 10 and FIG. 11. When the power source brings the carrier 2 to the left along the guiding shaft 36, the pressing rod 34 pushes the right bevel of the cam 28 and presses down the cam 28, causing the cam 28 to rotate in a small range about the axle 38, which causes the sliding pin 32 extending to the slit 29 of the cam 28 to move downward along the slit 30 of the sled 26. When the sliding pin 32 slides to the corner of the L-shaped slit 30, the limitation of horizontal movement to the sliding pin 32 as shown in the third state in FIG. 8 and FIG. 9 is released. The stretched elastic element 41A in the third state shrinks back to the left and pulls back the sled 26.

On the other hand, when the cam 28 moves the sliding pin 32 downward, the wiper holder 22 connected with the sliding pin 32 also moves downward, carrying the wipers 24A and 24B to descend and leave the surfaces F. The wiper holder 22 will recompress the elastic element 41B to a compressed state, generating a restoring force. Since the elastic element 41A pulls back the sled 26, the sliding pin 32 is kept at the rightmost horizontal position of the L-shaped slit 32 as shown in the first state in FIG. 4 and FIG. 5. Since the location of the sliding pin 32 in the slit 30 prevents the sliding pin 32 from moving upward, the elastic element 41B can be kept compressed, and specifically, the maintenance device 60 is in the first state again.

Additionally, the cam 28 not only has a right side bevel for the pressing rod 34 in the fourth state but also a left side bevel. Due to improper manipulation, transport instability, or initial setup requirements, the wiper holder 22, the wipers 24A and 24B and the cam 28 might inadvertently be in the higher positions shown in FIG. 6 to FIG. 9 when the carrier 2 has not yet entered the maintenance device 60. In such situation, the left bevel of the cam 28 of the present invention can prevent destructive collision between the pressing rod 34 and the cam 28 when the printer 50 is printing or proceeding to enter the maintenance device 60.

Compared with the prior art maintenance device, the present invention maintenance device introduces a print head cleaning method that saves the distance required for wipers to rise by making one end of a wiper holder to move up and down. Cost and size of the maintenance device are also reduced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A maintenance device for an inkjet cartridge comprising:

a housing;

a wiper holder having a sliding pin;

a sled installed in the housing capable of moving left and right, having a slit through which the sliding pin extends, the slit allowing the sliding pin to move an end of the wiper holder up and down;

an axle installed in the sled; and a cam connected to the axle having a slit through which the sliding pin extends;

wherein the cam, when pushed downward by the cartridge, presses down the sliding pin, moving the sliding pin down along both the slit of the sled and the slit of the cam, thus moving the end of the wiper holder downward.

2. The maintenance device of claim 1 further comprising a wiper, fixed to the wiper holder for cleaning the residual ink from a print head of the cartridge.

3. The maintenance device of claim 1 further comprising an elastic element connected from the housing to the wiper holder for pushing up the wiper holder.

4. The maintenance device of claim 3 wherein the elastic element is a spring.

5. The maintenance device of claim 1 further comprising an elastic element, connected from the housing to the sled for pulling the sled.

6. The maintenance device of claim 5 wherein the elastic element is a spring.

7. The maintenance device of claim 1 wherein both sides of the cam form a bevel.

8. The maintenance device of claim 1 wherein the sled has a protrusion on one end capable of being pushed by the cartridge to move the sliding pin along the slit of the sled, allowing the end of the wiper holder to move upward.

9. The maintenance device of claim 1 wherein the slit of the sled is L-shaped.

10. The maintenance device of claim 1 wherein the slit of the cam is a straight line.

* * * * *